US005619758A

United States Patent [19]

Burkett

[11] Patent Number: 5,619,758

[45] Date of Patent: Apr. 15, 1997

[54] HAND-HELD TOILET SEAT LIFTING DEVICE

[76] Inventor: Rebecca M. Burkett, 10773 Bent Mountain Rd., Bent Mountain, Va. 24059

[21] Appl. No.: 533,692

[22] Filed: Sep. 26, 1995

[51] Int. Cl.[6] ..... A47K 13/10

[52] U.S. Cl. ..... 4/246.1; 81/177.2; 294/19.1; 294/99.1

[58] Field of Search ..... 4/246.1–246.5; 81/177.2, 488; 16/114 R, 116 R, 124; 294/19.1, 99.1

[56] References Cited

U.S. PATENT DOCUMENTS

| | | | |
|---|---|---|---|
| 2,584,853 | 2/1952 | Elseg | 294/99.1 X |
| 2,616,741 | 11/1952 | Ziese | 294/19.1 |
| 3,093,402 | 6/1963 | Sisson | 294/19.1 X |
| 3,962,748 | 6/1976 | Michaels | 294/19.1 X |
| 4,165,115 | 8/1979 | Olsson | 16/114 R |
| 4,979,238 | 12/1990 | Clark | 4/246.1 |

*Primary Examiner*—Charles E. Phillips

[57] ABSTRACT

A hand-held toilet seat lifting device including an elongated handle having a hollow interior, an inboard end, a longitudinal aperture formed thereon, and a slot formed on the inboard end: an elongated strip having an inboard end slidably disposed within the interior of the handle and acting as spring, an outboard end, and an intermediate portion of a generally straight shape extended between the ends and through the slot on the handle, and with the strip and handle serving as a longitudinal extension to a user's hand, a button coupled to the inboard end of the strip and extended upwards through the aperture, and with the button being depressible to compress the spring and remove the protrusion from one of the notches, thereby allowing the strip to slide within the interior of the handle and permit telescopic adjustment of the outboard end of the strip; and a claming member coupled to the outboard end of the strip and having a pair of spaced engaging arms for clamping onto and removably holding a toilet seat.

7 Claims, 3 Drawing Sheets

HAND-HELD TOILET SEAT LIFTING DEVICE

BACKGROUND OF THE INVENTION

1. Field of the Invention

The present invention relates to a hand-held toilet seat lifting device and more particularly pertains to allowing a user to remotely and manually grasp and lift or lower a toilet seat, thereby preventing the user's hand from being contaminated with a hand-held toilet seat lifting device.

2. Description of the Prior Art

The use of toilet lifting aids is known in the prior art. More specifically, toilet lifting aids heretofore devised and utilized for the purpose of lifting or lowering a toilet seat are known to consist basically of familiar, expected and obvious structural configurations, notwithstanding the myriad of designs encompassed by the crowded prior art which have been developed for the fulfillment of countless objectives and requirements.

By way of example, U.S. Pat. No. Des. 296,658 to Mead et al. discloses a lifting handle for toilet seats or the like. U.S. Pat. No. Des. 309,091 to Shepard discloses a toilet seat handle. U.S. Pat. No. 4,129,907 to Vaughan et al. discloses a toilet seat handle. U.S. Pat. No. 4,805,246 to De Vargas et al. discloses a toilet seat handle. U.S. Pat. No. 4,850,062 to Gibson et al. discloses a toilet seat lifting aid. U.S. Pat. No. 4,920,586 to Giallourakis discloses a seat handle attachment.

While these devices fulfill their respective, particular objective and requirements, the aforementioned patents do not describe a hand-held toilet seat lifting device that allows a user to remotely and manually raise and lower a toilet seat.

In this respect, the hand-held toilet seat lifting device according to the present invention substantially departs from the conventional concepts and designs of the prior art, and in doing so provides an apparatus primarily developed for the purpose of allowing a user to remotely and manually grasp and lift or lower a toilet seat, thereby preventing the user's hand from being contaminated.

Therefore, it can be appreciated that there exists a continuing need for new and improved hand-held toilet seat lifting device which can be used for allowing a user to remotely and manually grasp and lift or lower a toilet seat, thereby preventing the user's hand from being contaminated. In this regard, the present invention substantially fulfills this need.

SUMMARY OF THE INVENTION

In the view of the foregoing disadvantages inherent in the known types of toilet lifting aids now present in the prior art, the present invention provides an improved hand-held toilet seat lifting device. As such, the general purpose of the present invention, which will be described subsequently in greater detail, is to provide a new and improved hand-held toilet seat lifting device and method which has all the advantages of the prior art and none of the disadvantages.

To attain this, the present invention essentially comprises, in combination, an elongated rigid plastic handle. The handle has a hollow interior, a generally rectangular cross-section, a flat lower wall, a flat upper wall, and a periphery interconnecting the walls formed of a pair of opposed side walls with an outboard end wall and an inboard end wall extended therebetween. Each side wall has a textured finger gripping surface formed thereon. The inboard end wall of the handle has a rectangular slot formed thereon in communication with the interior. The upper wall of the handle has an elongated rectangular aperture formed thereon for allowing access to the interior. This aperture is bounded by a rectangular edge formed of a pair of spaced parallel long edge portions with a pair of short edge portions extended therebetween. One of the long edge portions of the aperture has three spaced notches formed therealong.

An elongated rectangular metal strip is included. The strip has a U-shaped inboard end slidably disposed within the interior of the handle. This inboard end acts as a resilient spring. The strip also has a generally L-shaped outboard end and an intermediate portion of a generally straight shape extended between the inboard and outboard ends and through the slot on the inboard wall of the handle. The strip and handle serve as a longitudinal extension to a user's hand. The intermediate portion of the strip is sufficiently flexible as to permit its bending when force is applied thereto and yet sufficiently stiff as to return to its initial straight shape when force is removed therefrom.

A plastic button with a rectangular cross-section is provided. The button is coupled to the inboard end of the strip and extended upwards through the aperture on the handle. The button has a textured thumb gripping surface formed thereon and protrusion thereon that is removably engagable within one of the notches of the handle through upward force applied by the spring. The button is depressible to compress the spring and remove the protrusion from one of the notches, thereby allowing the strip to slide within the interior of the handle to permit the telescopic adjustment of the outboard end of the strip with respect to the handle.

Lastly, a generally C-shaped metal clamping member is included. The clamping member has a pair of generally parallel spaced engaging arms with a cross-leg therebetween. The cross leg is coupled to the outboard end of the strip with a rivet. Each engaging arm has an outboard tip end with a plastic pad affixed thereto. The spacing between the engaging arms is slightly less than a thickness of a toilet seat. The clamping member is sufficiently flexible as to permit the engaging arms to be bent away from each other and yet sufficiently stiff as to allow the pads on the engaging arms to clamp onto a toilet seat positioned therebetween. Each pad has a box-like central section with a planar outboard surface and a planar inboard surface, a forward section having a curved outboard extent as an extension of the outboard surface and a curved inboard extent as an extension of the lower surface. The radius of curvature of the outboard extent is greater than the radius of curvature of the inboard extent.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved hand-held toilet seat lifting device which has all the advantages of the prior art toilet lifting aids and none of the disadvantages.

It is another object of the present invention to provide a new and improved hand-held toilet seat lifting device which may be easily and efficiently manufactured and marketed.

It is a further object of the present invention to provide a new and improved hand-held toilet seat lifting device which is of durable and reliable construction.

An even further object of the present invention is to provide a new and improved hand-held toilet seat lifting device which is susceptible of a low cost of manufacture with regard to both materials and labor, and which accordingly is then susceptible of low prices of sale to the consuming public, thereby making such a hand-held toilet seat lifting device economically available to the buying public.

Still yet another object of the present invention is to provide a new and improved hand-held toilet seat lifting device which provides in the apparatuses and methods of the prior art some of the advantages thereof, while simultaneously overcoming some of the disadvantages normally associated therewith.

Even still another object of the present invention is to provide a new and improved hand-held toilet seat lifting device for allowing a user to remotely and manually grasp and lift or lower a toilet seat, thereby preventing the user's hand from being contaminated.

Lastly, it is an object of the present invention to provide a new and improved hand-held toilet seat lifting device comprising an elongated handle having a hollow interior, an inboard end, a longitudinal aperture formed thereon, and a slot formed on the inboard end; an elongated strip having inboard end slidably disposed within the interior of the handle and acting as spring, an outboard end, and an intermediate portion of a generally straight shape extended between the ends and through the slot on the handle, and with the strip and handle serving as a longitudinal extension to a user's hand, a button coupled to the inboard end of the strip and extended upwards through the aperture, and with the button being depressible to compress the spring and remove the protrusion from one of the notches, thereby allowing the strip to slide within the interior of the handle and permit telescopic adjustment of the outboard end of the strip; a generally C-shaped clamping member coupled to the outboard end of the strip and having a pair of spaced engaging arms for clamping onto and removably holding a toilet seat.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
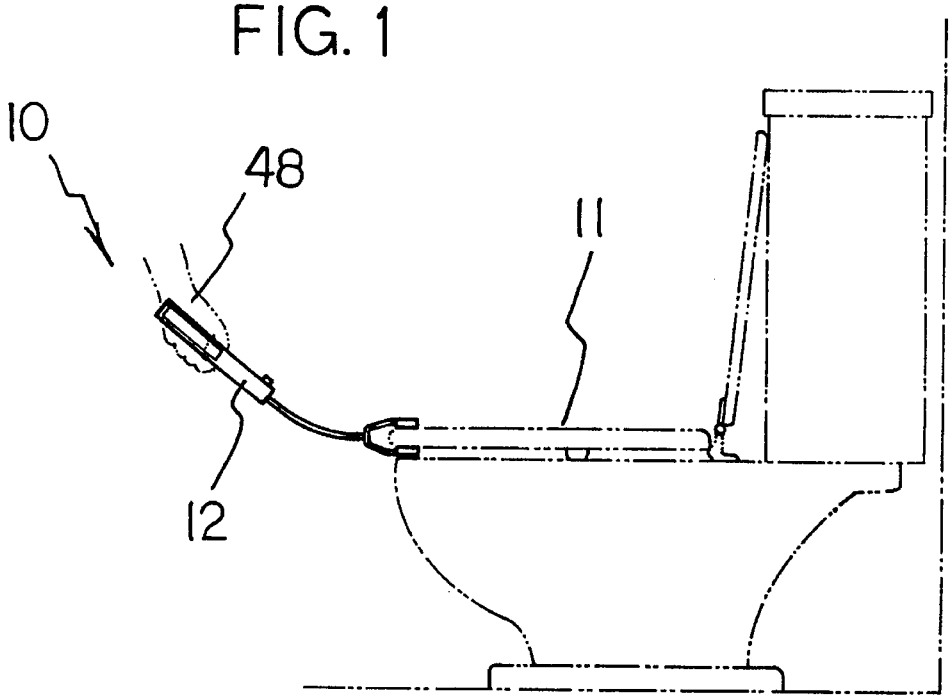
FIG. 1 is a side-elevational view of the preferred embodiment constructed in accordance with the principles of the present invention in use for lifting a toilet seat.

With reference now to the drawings, and in particular, to FIG. 1 thereof, the preferred embodiment of the new and improved hand-held toilet seat lifting device embodying the principles and concepts of the present invention and generally designated by the reference number 10 will be described.

The preferred embodiment of the present invention comprises a plurality of components. In their broadest context, such components include a handle, strip, button, and clamping member. Such components are individually configured and correlated with respect to each other to provide a structure that allows a user to remotely and manually grasp and then lift or lower a toilet seat 11, thereby precluding a user from possibly contaminating his hand. The present invention is especially useful in public restroom facilities, where the cleanliness and sanitary condition of a toilet seat cannot be readily ascertained.

Specifically, the present invention includes an elongated handle 12. The handle is formed of a rigid plastic. The handle has a hollow interior 14 and a generally rectangular cross-section. The handle also has a flat lower wall 16, a flat upper wall 18, and a periphery 20 interconnecting the walls 16, 18. The periphery is formed of a pair of opposed side walls 22 with an outboard end wall 24 and an inboard end wall 26 extended therebetween. Each wall has a generally planar structure. Each side wall has a rectangular and textured finger gripping surface 26 formed thereon. The inboard wall also has a rectangular slot 28 thereon. The slot 28 is placed in communication with the interior of the handle. The upper wall also has an elongated rectangular aperture 30 formed thereon that extends substantially along its longitudinal length. The aperture 30 allows access to the interior. The aperture 30 is further bounded by a rectangular edge 32. The edge is formed of a pair of spaced and parallel long edge portions 34 with a pair of short parallel edge portions 36 extended therebetween. One of the long edge portions has three equally-sized and spaced notches 38 formed therealong. One notch is positioned near the inboard end wall 26, another notch is positioned near the outboard end wall 24, and the remaining notch is positioned centrally therebetween.

Figure 2:
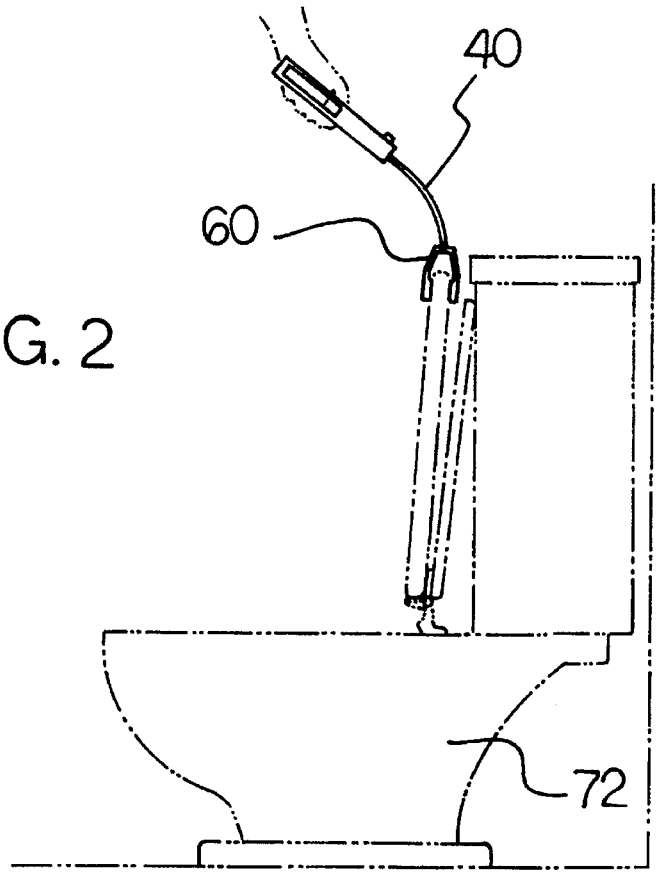
FIG. 2 is yet another side-elevational view of the preferred embodiment used for lowering a toilet seat.
Figure 3:
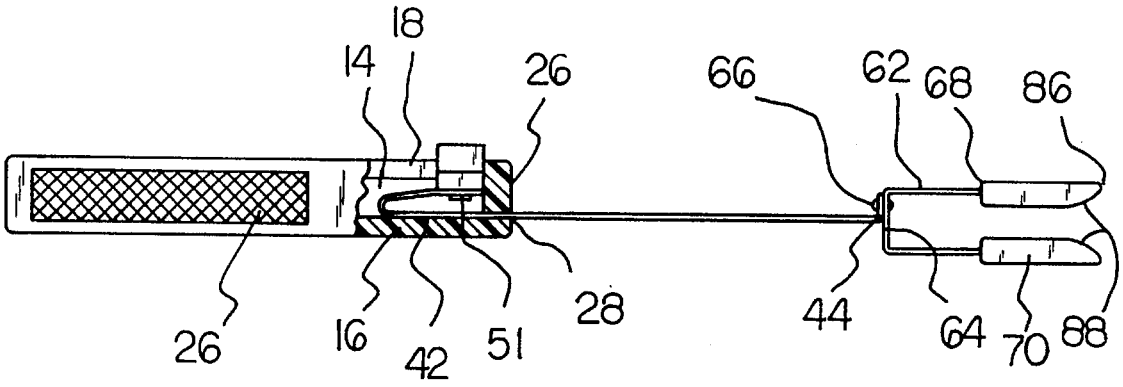
FIG. 3 is a side-elevational cutaway view of the preferred embodiment constructed in accordance with the principles of the present invention.
Figure 4:
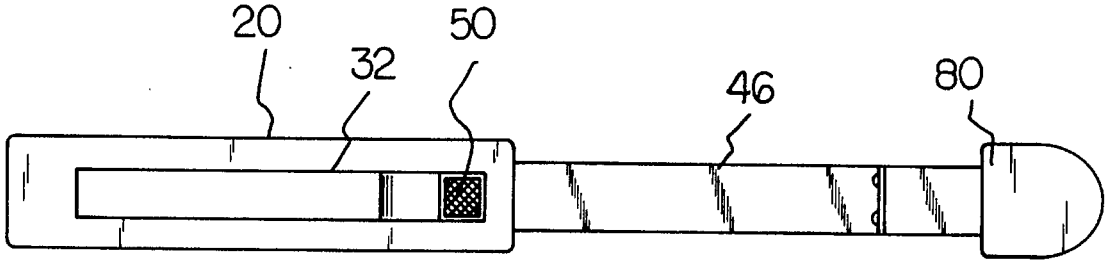
FIG. 4 is a plan view of the present invention.
Figure 5:
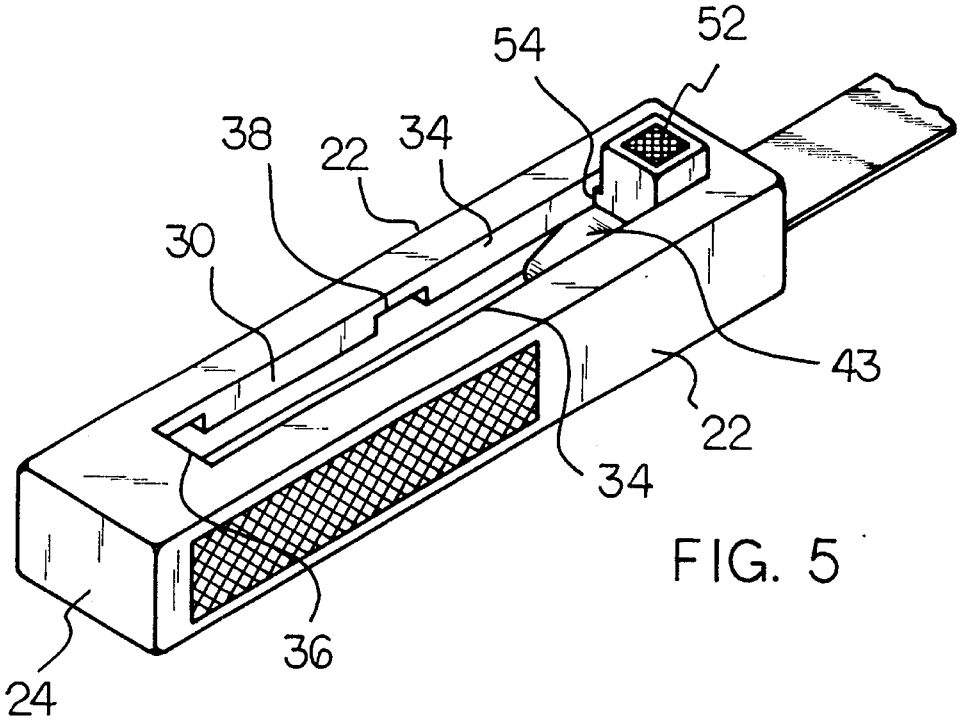
FIG. 5 is an enlarged view of the handle of the present invention.
Figure 6:
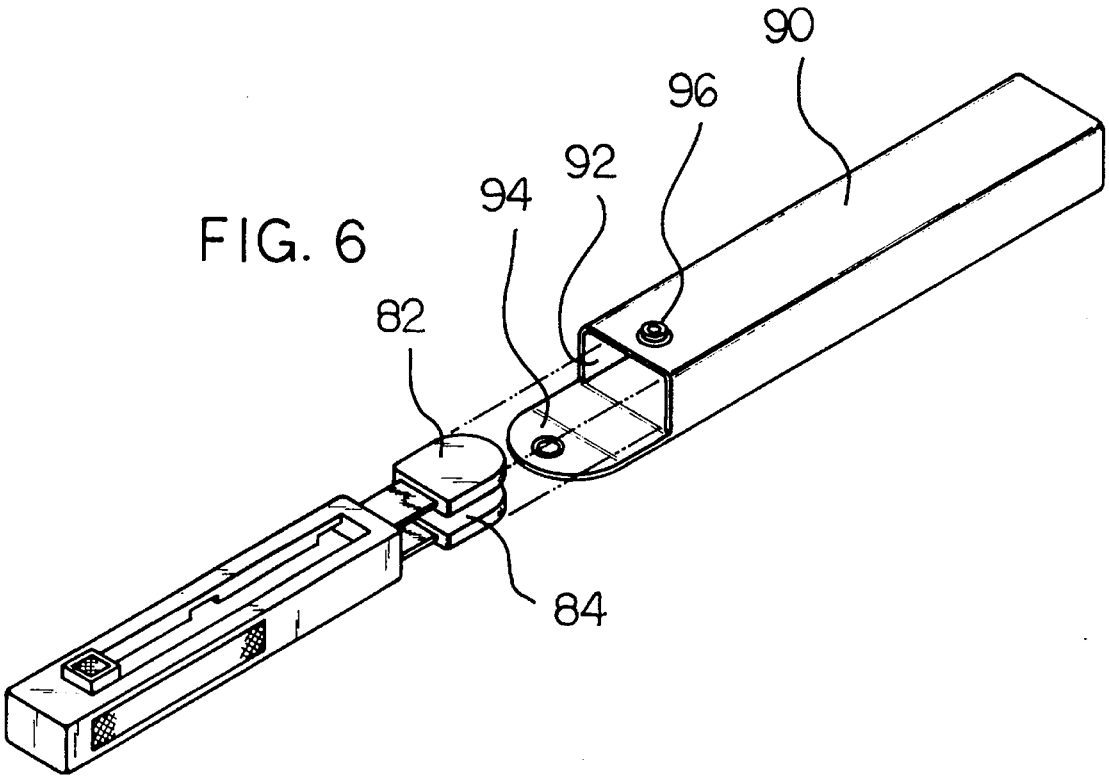
FIG. 6 is a perspective view of the present invention and its slidable securement within an included carrying pouch.

In addition, the present invention includes an elongated rectangular strip 40 formed of metal. The strip has a U-shaped inboard end 42. The inboard end 42 is slidably disposed within the interior 14 of the handle 12 and acts as a resilient spring 43. The strip also has a generally L-shaped outboard end 44. An intermediate portion 46 of a generally straight shape is extended between the inboard end 42 and outboard 44 and through the slot 28 on the inboard wall of the handle 12. The strip and handle serve as a longitudinal extension to a user's hand 48 and are generally aligned along a common axis. The intermediate portion of the strip is sufficiently flexible as to permit its bending when force is applied thereto by a user's hand as shown in FIGS. 1 and 2 and yet sufficiently stiff as to return to its initial straight shade when such force is removed.

A button 50 is coupled to the inboard end of the strip with a rivet 51. The button is formed of plastic and has a rectangular cross-section. The button is extended upwards through the aperture 30 and placed in sliding contact between the long edge portions 34 thereof. The button has a textured thumb gripping surface 52 formed thereon for providing a user's thumb a firm grip. A short protrusion 54 is formed on one side of the bottom and is removably engagable with one of the notches 38 of the handle 12 through upward force applied by the spring 43. The button is depressible by pressed applied by a user's thumb to compress the spring and remove the protrusion from one of the notches, thereby allowing the strip 50 to slide within the interior of the handle and permit telescopic adjustment of the outboard end 44. Thus, when the protrusion is placed in the notch near the inboard end wall 26, the strip is fully extended, and when the protrusion is placed in the notch near the outboard wall 24, the strip is fully retracted.

To grip a toilet seat, a generally C-shaped clamping member 60 is provided. The clamping member has a pair of generally parallel and spaced metal engaging arms 62. A metal cross-leg 64 is extended between the engaging arms and is also coupled to the outboard end of the strip with a metal rivet 66. Each engaging arm has an outboard tip end 68 with a plastic pad 70 affixed thereto. The spacing between the engaging arms is slightly less than the thickness of a toilet seat 11 of a toilet 72. Preferably, this spacing is about 1 inch or less to accommodate most conventional toilet seat thicknesses. The clamping member is sufficiently flexible as to permit the engaging arms 62 to be bent away from each other and yet sufficiently stiff as to allow the pads 70 on the engaging arms to clamp onto a toilet seat that is positioned therebetween. Thus, the clamp allows the toilet seat to be raised or lowered when secured thereto as shown in FIGS. 1 and 2. A pulling force can then be applied by the user to disengage the clamp from the toilet seat. Each pad on the clamp has a box-like central section 80 with a planar outboard surface 82 and a planar inboard surface 84. In addition, each pad has a forward section that has a curved outboard extent 86 as an extension of the outer surface and a curved inboard extent 88 as an extension of the inboard surface. The radius of curvature of the outer extent is greater than the radius of curvature of the inboard extent. The structure of the pads allows them to smoothly and readily slide upon and engage a toilet seat having a thickness slightly larger than the nominal spacing between the engagement arms.

The present invention can be readily transported from one location to another in a plastic rectangular box-shaped carrying case 90. The carrying case has a generally rectangular cross-section with a top opening 92 and an integral flap 94 that is securable over the opening with a snap fastener. The present invention is fully disposable within the case when in a fully retracted position. An unillustrated clip is attached to the carrying case to allow it to be secured to a recipient object such as a belt or other article of clothing.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A hand-held toilet seat lifting device comprising:

an elongated handle having a hollow interior, an inboard end, an outboard end and a longitudinal aperture formed between said ends, and a slot formed through the inboard end, said aperture is bounded by a rectangular edge formed of a pair of spaced parallel long edge portions with a pair of short edge portions extended therebetween, and with one of the long edge portions having a plurality of spaced notches formed therealong;

an elongated strip having an inboard end slidably disposed within said aperture of the handle and acting as spring, said strip having an outboard end, and an intermediate portion of a generally straight shape extended between the ends and through the slot in the handle, and with the strip and handle serving as a longitudinal extension to a user's hand, a button coupled to the inboard end of the strip and extended upwards through the aperture, and with the button being depressible to compress the spring and remove the protrusion from one of the notches, thereby allowing the strip to slide within the interior of the handle and permit telescopic adjustment of the outboard end of the strip; and wherein the button has a textured thumb gripping surface formed thereon and a protrusion thereon that is removably engagable within a selected one of the notches of the handle through upward force applied by the spring;

a generally C-shaped clamping member coupled to the outboard end of the strip and having a pair of spaced engaging arms for clamping onto and removably holding a toilet seat.

2. The hand-held toilet seat lifting device as set forth in claim 1 wherein the handle has a generally rectangular cross-section, a flat lower wall, a flat upper wall, and a periphery interconnecting the walls formed of a pair of opposed side walls with an outboard end wall and an inboard end wall extended therebetween, and with each side wall having a textured finger gripping surface formed thereon.

3. The hand-held toilet seat lifting device as set forth in claim 1 wherein the intermediate portion of the strip is sufficiently flexible as to permit its bending when force is applied thereto and yet sufficiently stiff as to return to its initial straight shape when force is removed therefrom.

4. The hand-held toilet seat lifting device as set forth in claim 1 and further comprising:

a pad affixed to each engaging arm, and wherein each pad has a box-like central section with a planar outboard surface and a planar inboard surface, a forward section having a curved outboard extent as an extension of the outboard surface and a curved inboard extent as an extension of the inboard surface, and wherein the radius of curvature of the outboard extent is greater than the radius of curvature of the inboard extent.

5. The hand-held toilet seat lifting device as set forth in claim 1 wherein the spacing between the engaging arms is less than about 1 inch.

6. The hand-held toilet seat lifting device as set forth in claim 1 wherein the clamping member is sufficiently flexible as to permit its engaging arms to be bent away from each other and yet sufficiently stiff as to allow its arms to clamp onto a toilet seat positioned therebetween.

7. A hand-held toilet seat lifting device for allowing a user to remotely and manually grasp and lift or lower a toilet seat comprising, in combination:

an elongated rigid plastic handle having a hollow interior, a generally rectangular cross-section, a flat lower wall, a flat upper wall, and a periphery interconnecting the walls formed of a pair of opposed side walls with an outboard end wall and an inboard end wall extended therebetween, with each side wall having a textured finger gripping surface formed thereon, the inboard end wall further having a rectangular slot formed thereon in communication with the interior, and the upper wall further having an elongated rectangular aperture formed thereon for allowing access to the interior, and with the aperture bounded by a rectangular edge formed of a pair of spaced parallel long edge portions with a pair of short edge portions extended therebetween, and with one of the long edge portions having three spaced notches formed therealong;

an elongated rectangular metal strip having a U-shaped inboard end slidably disposed within the interior of the handle and acting as a resilient spring, a generally L-shaped outboard end, and an intermediate portion of a generally straight shape extended between the ends and through the slot on the inboard wall of the handle, and with the strip and handle serving as a longitudinal extension to a user's hand, and wherein the intermediate portion of the strip is sufficiently flexible as to permit its bending when force is applied thereto and yet sufficiently stiff as to return to its initial straight shape when force is removed therefrom;

a plastic button with a rectangular cross-section coupled to the inboard end of the strip and extended upwards through the aperture, the button having a textured thumb gripping surface formed thereon, a protrusion thereon that is removably engagable within one of the notches of the handle through upward force applied by the spring, and with the button depressible to compress the spring and remove the protrusion from one of the notches, thereby allowing the strip to slide within the interior of the handle to permit the telescopic adjustment of the outboard end of the strip with respect to the handle; and a generally C-shaped metal clamping member having a pair of generally parallel spaced engaging arms with a cross-leg therebetween that is coupled to the outboard end of the strip with a rivet, each engaging arm having an outboard tip end with a plastic pad affixed thereto, and wherein the spacing between the engaging arms is slightly less than a thickness of a toilet seat, and wherein the clamping member is sufficiently flexible as to permit the engaging arms to be bent away from each other and yet sufficiently stiff as to allow the pads on the engaging arms to clamp onto a toilet seat positioned therebetween, and wherein each pad has a box-like central section with a planar outboard surface and a planar inboard surface, a forward section having a curved outboard extent as an extension of the outboard surface and a curved inboard extent as an extension of the lower surface, and wherein the radius of curvature of the outboard extent is greater than the radius of curvature of the inboard extent.

* * * * *